US005198187A

United States Patent [19]

Lu et al.

[11] Patent Number: 5,198,187

[45] Date of Patent: Mar. 30, 1993

[54] METHODS FOR PRODUCTION OF SURFACE COATED NIOBIUM REINFORCEMENTS FOR INTERMETALLIC MATRIX COMPOSITES

[75] Inventors: Lixion Lu, DeLand; Atul B. Gokhale; Reza Abbaschian, both of Gainesville, all of Fla.

[73] Assignee: University of Florida, Gainesville, Fla.

[21] Appl. No.: 794,944

[22] Filed: Nov. 20, 1991

[51] Int. Cl.[5] ..... B22F 1/02

[52] U.S. Cl. ..... 419/35; 419/24; 75/232; 75/235

[58] Field of Search ..... 419/35, 24; 75/232, 75/235

[56] References Cited

U.S. PATENT DOCUMENTS 4,223,434 9/1980 Wang et al. ..... 29/599

5,114,505 5/1992 Mirchandani et al. ..... 148/437

*Primary Examiner*—Donald P. Walsh

*Assistant Examiner*—Daniel Jenkins

*Attorney, Agent, or Firm*—Kerkam, Stowell, Kondracki & Clarke

[57] ABSTRACT

An improved method of forming a composite body of a metal, intermetallic or ceramic matrix reinforced with niobium filaments, particles, platelets or mixtures thereof, the method comprising admixing the niobium reinforcing material with powders of the matrix component elements, forming the admixture into a desired shape and converting the powders to a matrix reinforced with the niobium material, the improvement wherein the reinforcing material has a surface coating thereon of a compound $Nb_2O_5$, wherein the compound NbO reacts during formation of the matrix with a portion of at least one of the powdered elements to form a barrier layer at the reinforcer-matrix interface to prevent further reaction between the reinforcer and the matrix component elements. Also disclosed is a method of treating niobium particles, filaments, platelets or mixtures thereof by exposing the surface thereof to molecular $O_2$ at temperatures and pressure conditions such that the niobium and molecular $O_2$ react to form a surface coating on the niobium material of the compound $Nb_2O_5$. Also disclosed are the novel products of the above-described methods.

16 Claims, 3 Drawing Sheets

SCANNING AUGER ELECTRON MICROSCOPY PROFILE OF THE $Nb/NbAl_3$ INTERFACE WITH "IN-SITU" COATED ALUMINA LAYER

PROCESSING CYCLE

SCANNING AUGER ELECTRON MICROSCOPY PROFILE OF THE Nb/$NbAl_3$ INTERFACE WITH "IN-SITU" COATED ALUMINA LAYER

FRACTURE TOUGHNESS TEST
CHEVRON-NOTCHED 3 POINT BENDING
NbAl3 + 20 v/o Nb
WITH "IN-SITU"
ALUMINA COATING
NbAl3
LOAD
(lbs)
26
24
22
20
18
16
14
12
10
8
6
4
2
0
0
.20
.40
.60
DISPLACEMENT mm
NbAL3-20 VOL% Nb
NbAl3

METHODS FOR PRODUCTION OF SURFACE COATED NIOBIUM REINFORCEMENTS FOR INTERMETALLIC MATRIX COMPOSITES

BACKGROUND OF THE INVENTION

The present invention relates to reinforced intermetallic matrix composites and methods for their manufacture. Research leading to the completion of the invention described herein was supported in part by DARPA Grant No. MDA 972-B5-J-1006. The U.S. Government has certain rights in and to the invention described herein.

DESCRIPTION OF THE PRIOR ART

Reinforcements have long been employed to strengthen and otherwise modify the properties of metals, ceramics and intermetallic matrix composites. Generally, the reinforcements take the form of particles or filaments which are incorporated in the matrix of the composites by a variety of routes, including powder metallurgical (PM), molten metal (MM) or self-propagating high-temperature synthesis (SHS). While MM techniques are widely utilized for low-temperature composites (e.g., Al-matrix), they have not proven practical for making composites for high-temperature use.

Since the PM, MM and SHS techniques all require the utilization of elevated temperatures and pressures conducive to the initiation of undesirable reactions, there is a tendency for the reinforcing particles, filaments and/or platelets to react with one or more of the matrix components which may result in a degradation, embrittlement or other disadvantageous weakening of the reinforcing material.

For example, in the formation of niobium filament reinforced niobium aluminide matrix composites, particularly by PM or SHS methods, the niobium filaments react with the aluminum component of the matrix forming final products wherein degradation of the filaments is a serious problem.

It is an object of the invention to provide novel methods for the production of filament, particle and/or platelet reinforced metal, intermetallic or ceramic matrix composites not subject to the above-noted disadvantages and the composites produced thereby which possess a degree of superior quality matrix/reinforcement interfaces not evident in similar composites prepared by prior art methods.

It is a further object of the present invention to provide a method for the production of a surface coated filament, particle or platelet suitable for use in reinforcing metal, intermetallic and ceramic composites and the novel products produced thereby.

SUMMARY OF THE INVENTION

These and other objects are realized by the present invention, one embodiment of which provides an improved self-propagation high-temperature synthesis, molten metal or powder metallurgical method of forming a composite body comprising a metal, intermetallic or ceramic matrix reinforced with filaments, particles and/or platelets composed of a material containing element niobium, the method comprising admixing the particles, filaments and/or with powders of the matrix component elements, forming the admixture into a desired shape and subjecting the shaped admixture to temperature and pressure conditions sufficient to convert the powders to a metal, intermetallic or ceramic matrix reinforced with the filaments, particles and/or platelets, the improvement wherein the reinforcing filaments, particles and/or platelets admixed with the powders have a surface coating thereof of a compound $Nb_2O_5$, wherein the compound $Nb_2O_5$ reacts in situ during formation of the matrix with a portion of at least one of the powdered elements according to the equation $Nb_2O_5+Z \rightarrow ZO+Nb$, wherein Z is the at least one powdered element, and the reaction product ZO forms as a barrier layer at the filament, particle and/or platelet matrix interface to prevent or minimize further reaction between the filaments, particles and/or platelets and the matrix component elements.

A further embodiment of the invention provides a method of treating particles, filaments and/or platelets composed of a material containing elemental niobium comprising exposing a surface of the particles, filaments and/or platelets to molecular $O_2$ at temperature and pressure conditions such that the niobium and molecular $O_2$ react to form a surface coating on the particles, filaments and/or platelets of the compound $Nb_2O_5$.

Further embodiments of the present invention comprise the novel products produced according to the above-described methods.

DETAILED DESCRIPTION OF THE INVENTION

Figure 1:
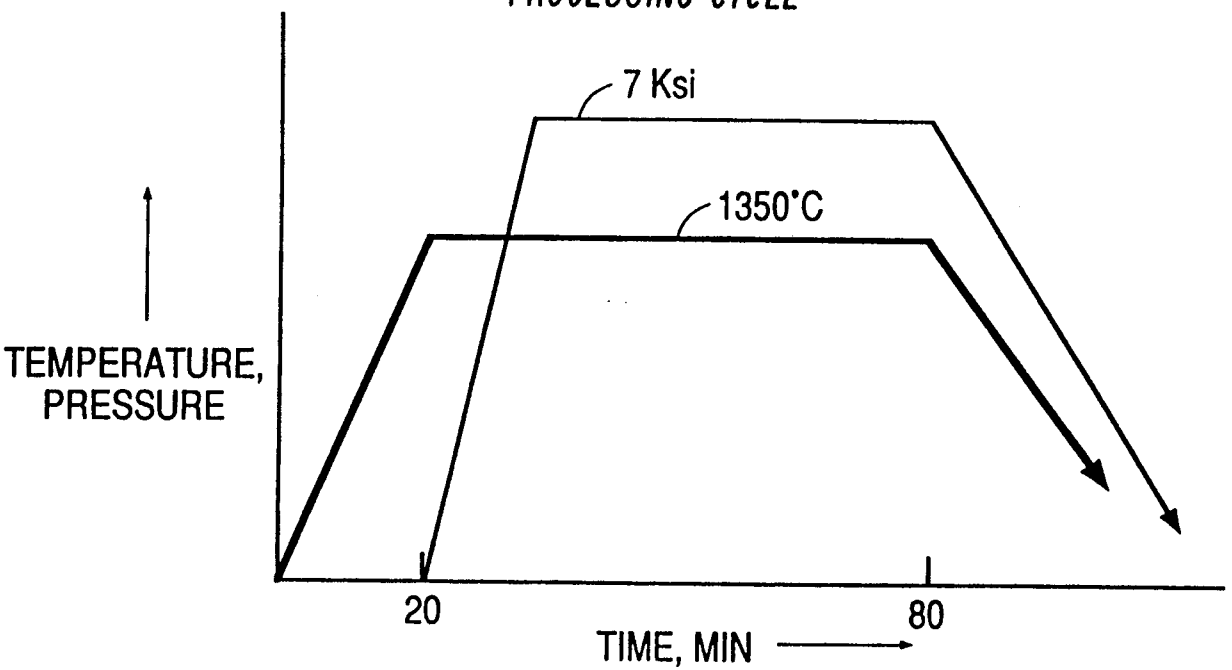
FIG. 1 is a graphical depiction of a typical hot pressing cycle according to a method of the invention.

The following terms are utilized herein and in the claims to define the methods and products of the invention and have the meanings and definitions normally associated therewith in the prior art except as indicated hereinafter.

The term "matrix" is intended to include any metal, intermetallic or ceramic body formed by MM, PM, SHS or other methods.

The term "filament" is intended to include any structure having an aspect ratio greater than about 3:1.

The term "particle" is intended to include any structure having a particle size greater than about 100 nm.

The term "platelet" is intended to include any structure having an aspect ratio greater than about 1:2.

The term "powder metallurgical" (PM) refers to the well known prior art technique for forming matrices from finely divided powders of the matrix components. Generally, the powders are intimately admixed with the reinforcing elements by high-speed blending techniques or conventional procedures such as ball milling. The mixture is then compressed to form a green compact which is then subjected to conditions of elevated temperature to initiate a reaction between the powdered materials to form the composite matrix and, if necessary, elevated pressure (e.g., by compression) to further aid in the densification of the matrix.

The term "molten metal" (MM) method is intended to include any of the well-known methods involving the direct addition of materials to molten metals. Further, molten metal infiltration of a continuous ceramic or metallic skeleton has been used to produce composites. In most cases, elaborate particle coating techniques have been developed to protect the particles from the molten metal during admixtures or molten metal infiltration, and to provide bonding. Techniques such as these have resulted in the formation of silicon carbide-aluminum composites, frequently referred to as SiC/Al, or SiC aluminum. This approach is only suitable for large particulate ceramics (e.g., greater than 1 micron) and whiskers because of the high pressures involved for infiltration. In the molten metal infiltration technique, the ceramic material such as silicon carbide is pressed to form a compact, and liquid metal is forced into the packed bed to fill the interstices. Such a technique is illustrated by Yamamoto et al in U.S. Pat. No. 4,444,603 issued Apr. 24, 1984.

In recent years, numerous composites have been formed using a process referred to as self-propagating, high-temperature synthesis (SHS), which involves an exothermic, self-sustaining reaction which propagates through a mixture of compressed powders. The SHS process involves mixing and compacting powders of the constituent elements and heating the green compact. Sufficient heat is released to support a self-sustaining reaction, which permits the use of sudden, low-power initiation of high temperatures rather than bulk heating over long periods at lower temperatures. See U.S. Pat. Nos. 3,726,643; 4,161,512; and 4,431,448.

As will be apparent from the following description of the invention, the MM, PM and SHS methods do not in and of themselves constitute the crux of the invention. Rather, the invention comprises an improvement in the composite microstructures during utilization of these methods which results in the production of matrix/reinforcement interface coatings in a much more efficient and economical manner.

The term "surface coating" as used herein refers to the coating of $Nb_2O_5$ formed on the surface of the reinforcing filaments, particles and/or platelets via the pre-oxidation treatment, as well as the layer of $Al_2O_3$ formed as a result of the reaction between $Nb_2O_5$ and Al and the partial diffusion of oxygen into the filament and/or particle.

The invention is particularly adapted for the treatment of wires, filaments (smaller than "wires" but polycrystalline), whiskers (generally single crystal) and/or particles containing niobium intended for use as reinforcing agents for metal, intermetallic or ceramic matrix composites.

It is only necessary that at least one of the elements present therein (designated "Z" herein) react under some of the conditions prevailing in the formation of the metal, intermetallic or ceramic matrix with the surface coating of $Nb_2O_5$ to produce ZO and free niobium according to the reaction equation $Nb_2O_5+Z \rightarrow ZO+Nb$. Typical of such elements are Al and Ti.

The surface coating NbO is formed on the filaments, particles and/or platelets by exposing the surfaces thereof to molecular $O_2$ under conditions of temperature and pressure sufficient to form thereon a surface coating of NbO. The conditions of temperature and pressure necessary to achieve the formation of the coating may vary. Generally, however, the temperature may range from about 400° C. to about 800° C. and the pressure may vary from about 0.5 atm (at higher temperatures) to about 1 atm (at lower temperatures).

The reaction is conducted only for a time sufficient to form a thin surface coating of $Nb_2O_5$ (as well as a partially diffused layer of Nb-O solid solution just below the surface) in the niobium-containing material, i.e., for about 1-15 minutes.

Preferably, the niobium-containing surface is cleaned by etching in a suitable solvent. Most preferred is at 1:2 mixture of $HF+HNO_3$ which satisfactorily etches the niobium-containing surface.

Most preferably, the etched surface is then degreased in an aqueous solution of methanol or other suitable grease solvent.

As noted above, the particular MM, PM or SHS technique employed is not critical to the practice of the invention. Any suitable such method may be employed provided that it is suitable for forming the particular reinforced composite desired and further provided that the conditions thereof enable the formation of the ZO barrier layer.

In a preferred embodiment, the pre-oxidized Nb filaments are mixed with elemental niobium and aluminum powders (typically in a ratio to yield $NbAl_3$ in the final product) and are cold-compacted according to conventional techniques, e.g., under a pressure of 10 ksi. The cold-compacted articles are hot pressed according to conventional methods [Lu et al, "'In-Situ' Formation of Alumina Interface Coating in Reactively Synthesized $NbAl_3$/Nb Composites," *Innovative Inorganic Composites*, ASM, Detroit (Oct. 9-11, 1990)]. During hot pressing, the niobium oxides (mostly $Nb_2O_5$) react with aluminum to form alumina "in situ." The reaction occurs in two major stages: (1) after the Al becomes liquid and (2) during the synthesis of the matrix. Subsequent compositional analysis demonstrates that the matrix/reinforcement interactions are greatly reduced by the presence of the alumina layer.

The many advantages of the method of the invention over prior art methods include: low cost, more efficient control of the overall process and less degradation of the interface layer during fabrication.

The invention is illustrated by the following non-limiting example.

EXAMPLE 1

Niobium filament reinforcements (250 μm diameter × 5 mm length) were cleaned in acetone followed by surface etching in a 1:2 mixture of $HF+HNO_3$ and finally a methanol wash in order to degrease the surface. The cleaned filaments were heated for ten minutes in an atmosphere controlled quartz tube which was placed in a furnace maintained at 500° C. The quartz tube was initially purged with pure oxygen and maintained at one atmosphere of oxygen thereafter. i During the oxidation treatment, the quartz tube containing the filaments was rotated to ensure a uniform exposure of the niobium filament surfaces to the oxygen atmosphere. This treatment produced an Nb+O solid solution with a thin layer of niobium oxide on the surface.

The pre-treated reinforcements were blended with pure elemental powders of Al and Nb in a cylindrical blender for one hour. The average size of the Al and Nb powders mixed in the ratio (by weight) 23:27 was 6.2 and 45 μm, respectively. The elemental powder-filament mixture was cold-compacted into a disk shape under a pressure of 10 ksi.

The cold-compacted disks were hot-pressed in a BN-coated graphite die. The hot pressing was carried out at 1,350° C. with a total cycle time of ~145 minutes. The typical hot-pressing cycle is shown in FIG. 1. The cycle consisted of an initial heat-up period during which the sample is heated from ambient temperature to 1,350° C. at a heating rate of 70° C./minute. During this time, the sample was not pressurized. After attainment of the final processing temperature (1,350° C.), the sample was pressurized to a pressure of 5 ksi. These pressure-temperature conditions were maintained for sixty minutes, following which the sample was cooled under pressure at a rate of ~20° C./min.

Figure 2:
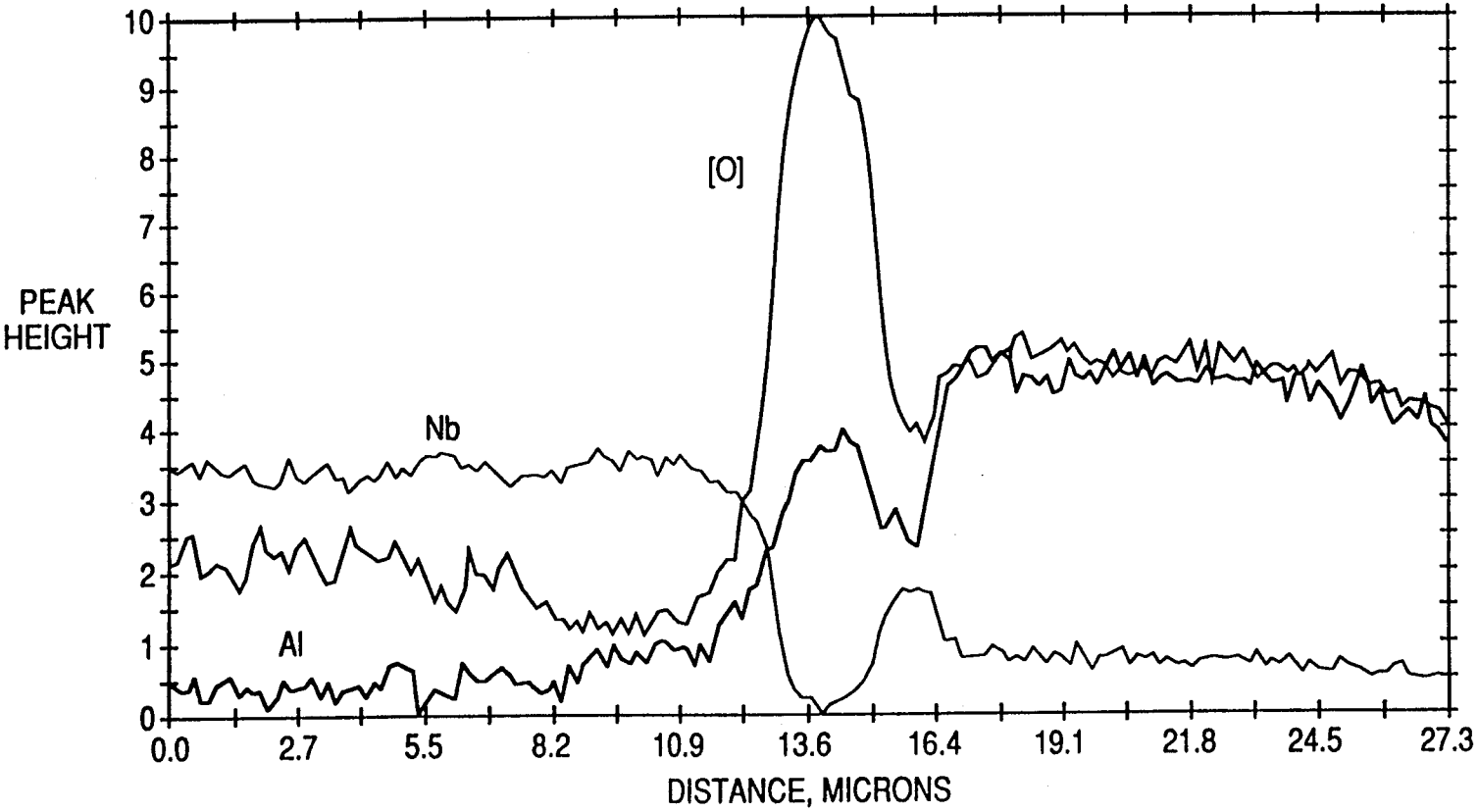
FIG. 2 is a scanning auger electron microscopy profile of an $Nb/NbAl_3$ interface with a coated alumina layer.

During the first stage of the processing cycle, as the temperature of the sample exceeds the melting temperature of Al (660° C.), liquid aluminum is redistributed inside the powder compact and comes in intimate contact with the pre-treated Nb filament reinforcements. Upon the establishment of such contact, the liquid aluminum reacts with the oxide on the surface of the Nb filaments. This reaction results in a reduction of the niobium oxide and the formation of an alumina layer at the filament/liquid interface. The driving force for this reaction stems from a higher free energy of formation of alumina compared to that of niobium oxide. The alumina layer isolates the Nb filaments from the surroundings and prevents (or significantly reduces) further reactions. Compositional analysis of the coating by auger electron microscopy is shown in FIG. 2 and indicates that only Al and O are present on the filament surface.

A further increase in temperature leads to a reaction between the Nb powder particles and liquid aluminum. The driving force for this reaction is the reduction in the free energy of the system through the formation of $NbAl_3$. The $NbAl_3$ formation reaction is highly exothermic and can be self-sustaining with the reaction propagation occurring at a relatively high rate. The formation of $NbAl_3$ succeeds the formation of alumina because of its higher activation energy barrier.

It is critical to the success of the invention that, without the prior alumina formation on the Nb filament surface, these filaments would also participate in the $NbAl_3$ formation reaction, which would result in a degradation of the reinforcement. In addition, such uncoated filaments would continue to interact with the matrix, thus leading to a highly undesirable situation, i.e., a microstructurally unstable composite.

The chemical and microstructural stability of the barrier layer coating was assessed by annealing the composite for 100 hours at 1,200° C. For comparison, the composites containing uncoated Nb filaments were also annealed under similar conditions. A scanning electron micrograph of the interfacial region between a coated Nb filament and the $NbAl_3$ matrix illustrates that the coating has good stability and shows no evidence of spalling. The extent of matrix/filament interaction for the coated and uncoated filaments was assessed via micro-hardness profiles. The profiles for the uncoated and coated filaments show a clear decrease of the indentation area upon traversing from the center to the surface of the filament. This indicates an increase in the hardness of the filament with increasing Al content of the filament. By contrast, the coated filament does not exhibit an increase in the micro-hardness near the periphery, indicating a near-absence of filament/matrix interaction during the long-term annealing treatment. Thus, it is clear that the in situ coating process produces a coating which is both microstructurally and compositionally stable.

Figure 3:
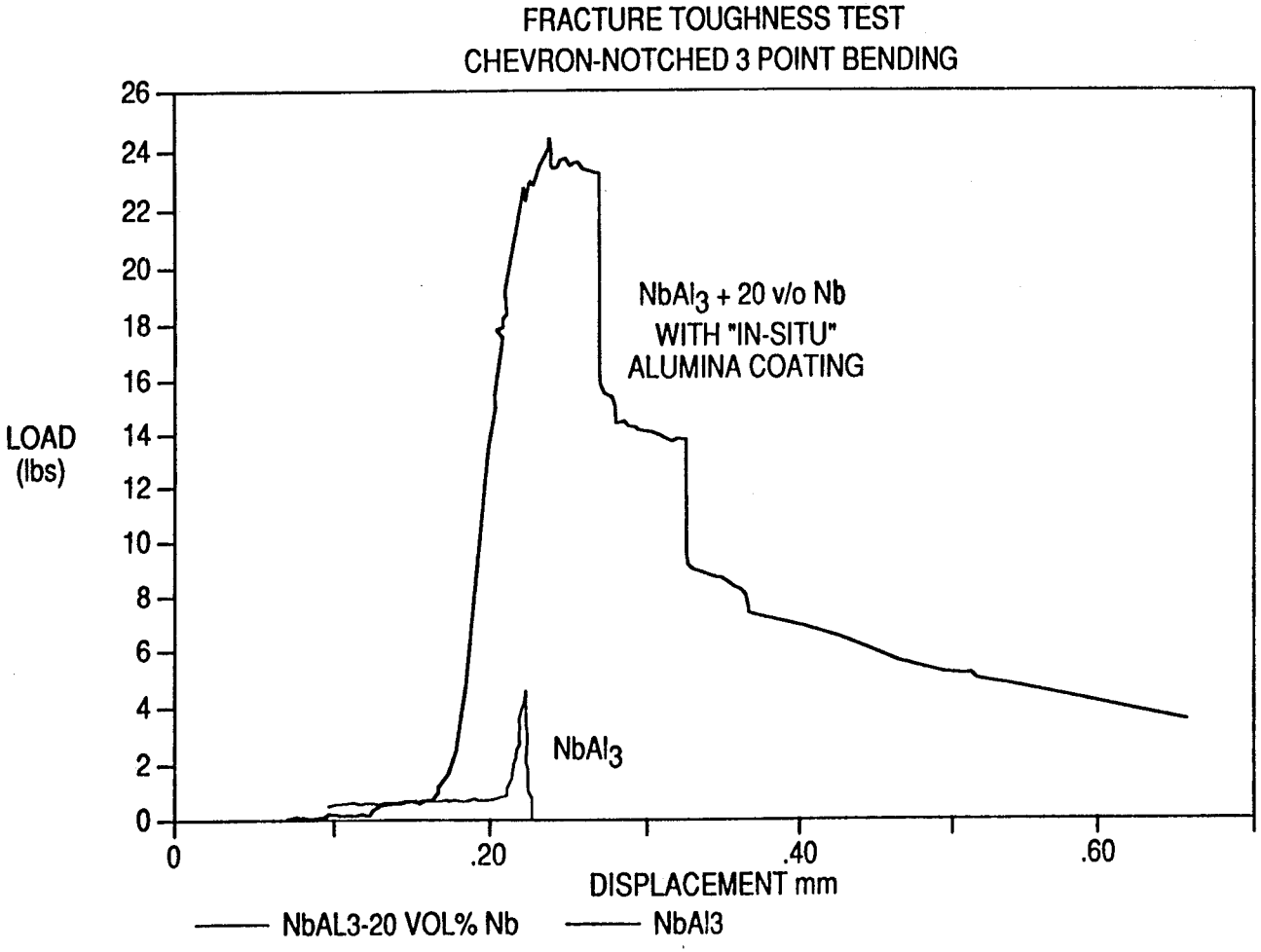
FIG. 3 is a graphical depiction of a fracture toughness test performed on a product produced according to the method of the invention.

The fracture toughness of the monolithic matrix (i.e., without any reinforcement) and the Nb filament reinforced composites were measured using chevron-notched specimens tested under three-point bending. A comparison between the load-displacement behavior of the monolithic matrix and a 20 vol. % Nb (in situ coated) filament reinforced composite is shown in FIG. 3. The figure illustrates the extremely brittle nature of the monolithic matrix compared to the composite which exhibits a significant increase in the toughness. Calculation of the critical stress intensity factors ($K_{IC}$'s) from these plots indicated that the fracture toughness of the composite was approximately five times greater than the monolithic matrix (9.6 compared to 1.7 $MPa \bullet \sqrt{m}$).

Fracture surface analysis indicated that the barrier alumina coating played a key role in increasing the fracture toughness. For example, it was found that the coated Nb filaments failed in a ductile manner. Because the ductile fracture of the reinforcement can only be caused by a very effective load transfer, it is clear that the filament/matrix interface possesses optimum properties in terms of providing partial de-cohesion and allowing filament "pull-out."

The method of the invention can be applied to a wide variety of metal, intermetallic and ceramic matrix composite systems.

The process of the invention uses a pre-treatment of reinforcements to incorporate certain elemental species on or immediately below their surface regions. Next, the pre-treated reinforcements are mixed with the elemental components of the matrix material (which may typically be in the form of powders). Subsequently, during synthesis of the matrix and consolidation of the mixture (typically via hot compaction), certain elemental species in the matrix react with the elemental species on the reinforcement surface which have been introduced via the pre-treatment. This reaction leads to the formation of the oxide at the matrix/reinforcement interface. Such a compound layer can act as an effective diffusion barrier to prevent or significantly reduce further interactions between the matrix and the reinforcement. This is highly desirable for producing composites which are stable during high temperature service. In addition, the characteristics of the protective layer can be controlled to impart additional toughening to the composite. The commercial applicability of this process is significant because it can be applied to a wide range of matrix/reinforcement combinations. The process is especially applicable to advanced high-temperature composites in which degradation of reinforcements can pose a serious obstacle.

Other examples which are illustrative of the invention are as follows.

EXAMPLE 2

In Nb reinforced $TaTiAl_2$ (matrix) composites, surface pre-oxidized Nb filaments also yielded a layer of alumina at the matrix/reinforcement interfaces.

EXAMPLE 3

In Nb reinforced NiAl (matrix) composites, surface pre-oxidized Nb filaments gave rise to an alumina layer at the matrix/reinforcement interfaces.

In the latter two examples, the oxidation pre-treatment was similar to that used for $Nb/NbAl_3$ composites. However, for the $Nb/TaTiAl_2$ composites, the matrix was initially in a pre-alloyed form instead of the elemental powder mixtures used in the case of the $NbAl_3$ matrix or the NiAl matrix.

We claim:

1. In a self-propagating, high-temperature synthesis, molten metal or powder metallurgical method of forming a composite body comprising a metal, intermetallic or ceramic matrix reinforced with a member selected from the group consisting of filaments, particles, platelets and mixtures thereof composed of a material containing elemental niobium, said method comprising admixing said reinforcing member with powders of said matrix component elements, forming said admixture into a desired shape and subjecting said shaped admixture to temperature and pressure conditions sufficient to convert said powders to a metal, intermetallic or ceramic matrix reinforced with said reinforcing member, the improvement wherein:

said reinforcing member admixed with said powders has a surface coating thereon of a compound $Nb_2O_5$, wherein said compound $Nb_2O_5$ reacts in situ during formation of said matrix with a portion of at least one of said powdered elements according to the equation $Nb_2O_5+Z \rightarrow ZO+Nb$, wherein Z is said at least one powdered element and the reaction product ZO forms as a barrier layer at the reinforcing member/matrix interface to prevent further reaction between said reinforcing member and said matrix component elements.

2. The method of claim 1 wherein said reinforcing member consists essentially of niobium.

3. The method of claim 1 wherein said matrix component elements are selected from the group consisting of Al, Ti, Ni, Ta and Nb.

4. The method of claim 1 wherein said reinforcing member consists essentially of Nb, said surface coating is essentially $Nb_2O_5$, said matrix component elements are Nb and Al, or Ta, Ti and Al, or Ni and Al, and said barrier layer reaction product is alumina.

5. The method of claim 4 wherein said matrix is $NbAl_3$.

6. The method of claim 4 wherein said matrix is $TaTiAl_2$.

7. The method of claim 4 wherein said matrix is NiAl.

8. The product produced by the method of claim 1.

9. A method of treating a member selected from the group consisting of particles, filaments, platelets and mixtures thereof composed of a material containing elemental niobium comprising exposing a surface of said member to molecular $O_2$ at temperature and pressure conditions such that said niobium and molecular $O_2$ react to form a surface coating on said member of the compound $Nb_2O_5$.

10. The method of claim 9 wherein said member consists essentially of niobium.

11. The method of claim 9 wherein said surface coating is essentially $Nb_2O_5$.

12. The method of claim 9 including the preliminary steps of cleaning and degreasing said surfaces of said member.

13. The method of claim 12 wherein said preliminary cleaning step comprises etching said surfaces of said member.

14. The method of claim 13 wherein said surfaces are etched with a mixture of HF and $HNO_3$.

15. The method of claim 12 wherein said surfaces are degreased by contact with a solution containing methanol.

16. The product produced by the method of claim 9.

* * * * *